United States Patent [19]

Milasius

[11] 3,980,801

[45] Sept. 14, 1976

[54] TILT AND SWING LOCK MECHANISM FOR ELECTRIC FURNACE

[75] Inventor: Algimantas Milasius, Chicago Heights, Ill.

[73] Assignee: Whiting Corporation, Harvey, Ill.

[22] Filed: Sept. 5, 1975

[21] Appl. No.: 610,693

[52] U.S. Cl. ..... 13/10
[51] Int. Cl.[2] ..... F27B 14/02
[58] Field of Search ..... 13/9, 10

[56] References Cited

UNITED STATES PATENTS

| | | | |
|---|---|---|---|
| 3,684,261 | 8/1972 | Wynne | 13/10 UX |
| 3,745,224 | 7/1973 | Ames | 13/10 |

*Primary Examiner*—R. N. Envall, Jr.
*Attorney, Agent, or Firm*—Lockwood, Dewey, Zickert & Alex

[57] ABSTRACT

A mechanical tamper-resistant interconnecting locking apparatus is connected to a top charge tiltable direct arc electric furnace which includes a refractory lined furnace shell and a removable roof covering a top opening in the shell.

The apparatus includes a first locking mechanism which, when engaged, prevents the tilting of the furnace, and a second locking mechanism which, when engaged, prevents the swinging of the roof from over the shell top opening. A mechanical linkage interconnects the two mechanisms and prevents simultaneous disengagement of both of them. Also, once one of the mechanisms is disengaged and adjacent portions of the furnace are moved relative to each other, the entire locking apparatus is prevented from further movement until the adjacent portions are returned to the position providing lock mechanism engageability.

11 Claims, 10 Drawing Figures

FIG. 7
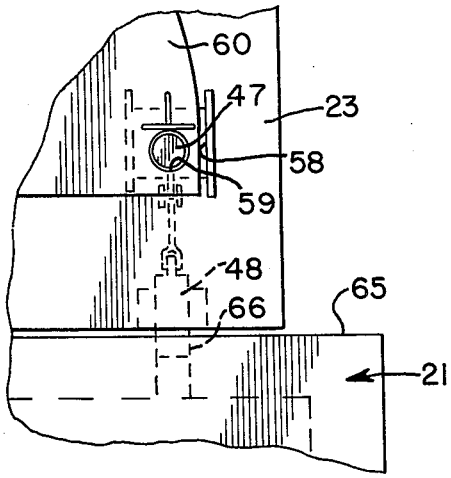
FIG. 8
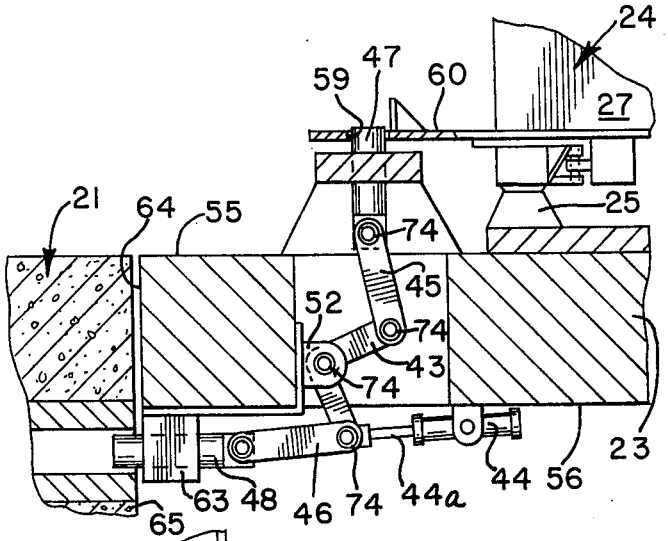
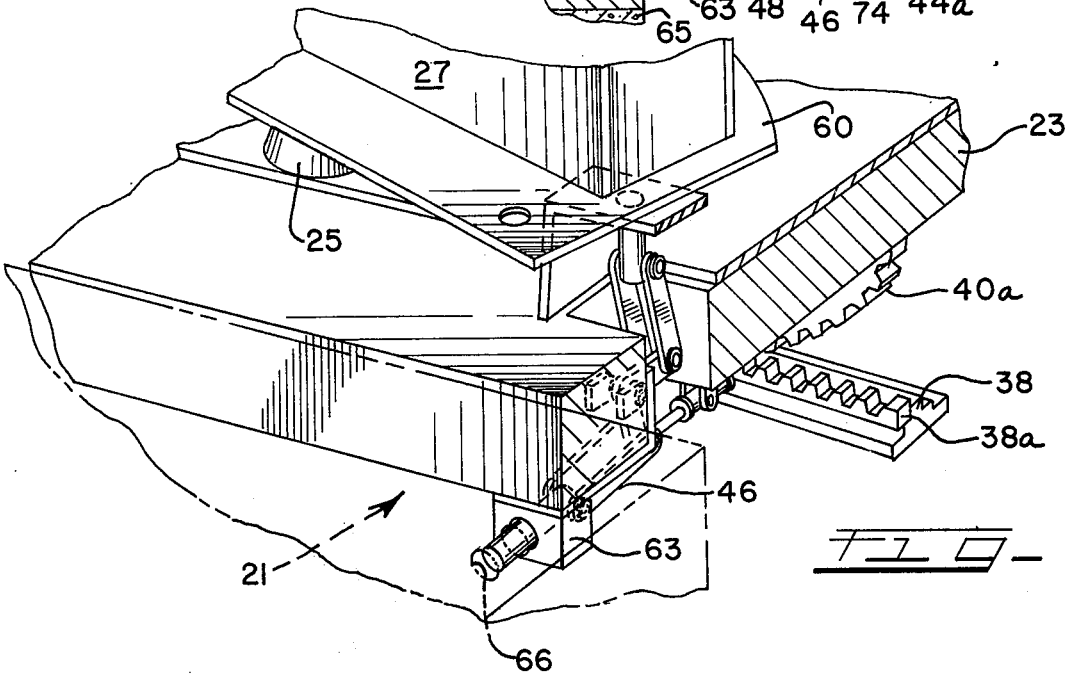
FIG. 9
FIG. 10
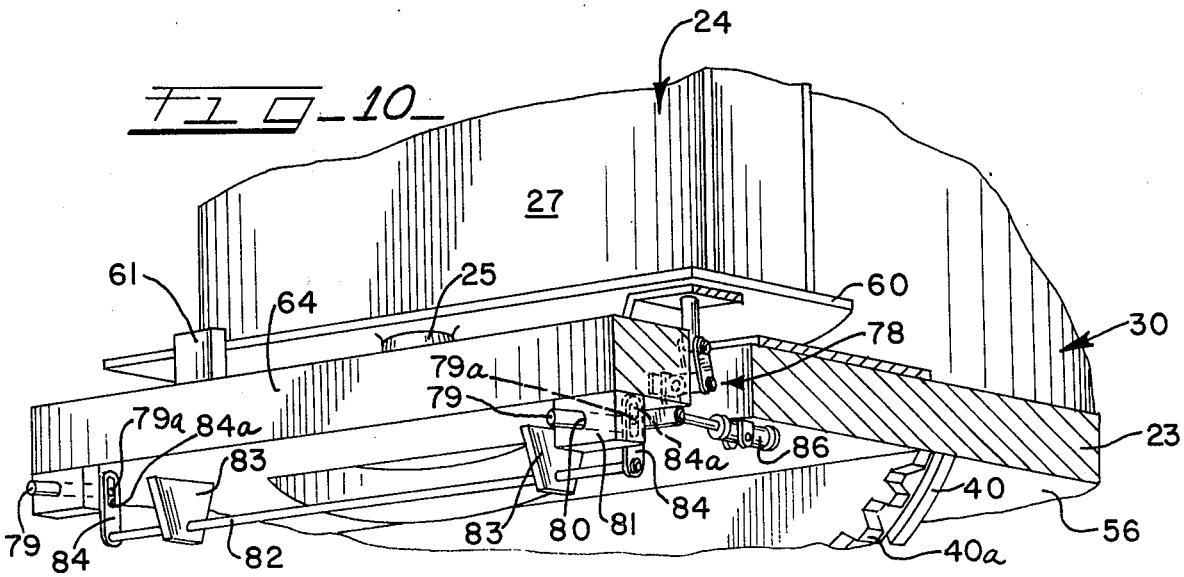

TILT AND SWING LOCK MECHANISM FOR ELECTRIC FURNACE

This invention relates to tiltable top charge electric arc furnaces for use in melting metals, and, more specifically, to a plurality of locking mechanisms and an interconnecting mechanical linkage between same for use in the above type furnaces for preventing unintentional furnace tilting.

Electric arc furnaces have long been used for melting metals, such as steel, iron and the like. Such furnaces are especially useful for making steel from high percentages of scrap materials.

Conventional electric arc furnace installations of the top charge tilting variety are disclosed in Patent 2,396,663 issued to the assignee of the present application. This type of furnace includes a framework tiltably mounted on a foundation and a refractory-lined material receiving furnace shell mounted in the framework. A refractory-lined roof covers the open top of the shell, and is removable by being raised from the shell and then swung through a horizontal arc away from the shell opening for allowing materials to be charged therein. Electrodes are mounted in vertical position through the roof and are inserted into the shell. The shell also includes an opening or pour spout through which molten steel exits the furnace, and a second opening or spout through which slag or waste materials are removed. The metal is poured by tilting the framework and the covered shell thereon on the foundation until the metal pours out of the spout provided therefor.

A potential problem with this type of top charge tilting furnace is the shift which occurs in the center of gravity when the roof is swung to its open position. If the roof is swung arcuately outward from the shell in the direction in which the furnace is tiltable, its center of gravity is shifted sufficiently forward so that the furnace will be unstable and will tilt unless restrained, as by a tilt lock.

Sophisticated electrical and electro-mechanical control systems have been developed to prevent the tilting of such an electric arc furnace if its roof is in any position other than mounted on top of the shell. However, electrical relays in such systems may be bypassed or jumped by operating employees or repairmen thus creating a potentially hazardous condition.

Known mechanical tilt-swing interlocks have several short comings. While the furnace is structured to tilt forward and backward from a level position, tilting movement is prevented only in the forward direction. Also, there is no substantial lock engagement overlap built into the interlock to assure safe operation even after repeated wear and heat exposure. Further, known interlock systems do not prevent accidental swing lock disengagement after the tilt lock has been disengaged and the furnace tilted.

Applicant's invention solves the above problems by being directed to a top charge tiltable direct-arc electric furnace including a foundation, and a furnace body mounted on a framework including a roof support structure which is swingable on the framework for opening and closing the body. The improvement comprises mechanically interconnected means for preventing the furnace body from tilting and for preventing the roof from being horizontally swung over the body, and the engagement of the means for preventing the tilting being substantially overlapped with the engagement of the means for preventing the swinging whereby simultaneous engagement of the means allowing tilting and swinging is prevented.

Applicant's invention is further directed to an electric arc furnace of the type having in combination: a stationary foundation; a supporting framework mounted upon the foundation; a hollow shell means mounted in the framework which is enclosed at the bottom end and open at the top; a removable roof means mounted on the supporting framework for covering the open top of the shell means; the roof means being swingable through horizontal arc and uncovering the shell open top for charging material to the furnace; the framework being tiltable upon the foundation for allowing molten metal to flow out of the shell means; a first locking mechanism providing engagement between the framework and the foundation for preventing the furnace from tilting; a second locking mechanism providing engagement between the roof means and the framework for preventing the cover from being horizontally swung from over the body; a mechanical interconnection therebetween; and means on the furnace for blocking the movement of both the first and second locking mechanisms once the framework is tilted or once the roof is swung from over the body.

It is therefore an object of this invention to provide a top charge tiltable direct arc electric furnace with a tamper-resistant mechanical locking means for preventing the tilting of the furnace if the furnace structure is in a position such that there is a possibility any tilting may be unsafe.

Another object of my invention is the provision of a mechanically interlocked tilt lock and roof swing lock which is mechanically locked against changing position between locking against tilting and locking against swinging except when the furnace is in a substantially level position.

Another object of the invention is the provision of a mechanically interconnected tilt and swing lock mechanism for a top charge tiltable direct arc electric furnace such that when the furnace is tilted, the swing lock pin is mechanically blocked from inward disengaging movement; and when the furnace roof is swung, the tilt lock pin is blocked from inward disengagement by the furnace roof back plate assembly.

A further object of the invention is the provision of mechanically interconnected furnace tilt lock and furnace roof swing lock mechanisms in a top charge tiltable direct arc electric furnace having a substantial lock engagement overlap for preventing the simultaneous disengagement of both mechanisms even after repeated wear and exposure to extreme heat conditions.

A still further object of the invention is a provision of a top charge direct arc electric steel-making furnace wherein the furnace tilt locking mechanism and the furnace roof swing locking mechanism may not be bypassed or avoided during operation of the furnace.

Other objects, features, and advantages of the invention will be apparent from the following detailed disclosure taken in conjunction with the accompanying drawings, wherein like reference numerals refer to like parts, in which:

FIG. 7 is an enlarged fragmentary detail view of the locking mechanism shown in the lower left corner of FIG. 3;

FIG. 8 is an enlarged fragmentary detail view partially cut away similar to FIGS. 4 and 6 wherein the tilt and swing lock mechanisms are in overlapping engaged positions;

FIG. 9 is a fragmentary perspective view partially cut away similar to FIG. 5 showing the tilt lock mechanism engaged, the swing lock mechanism disengaged, and the furnace roof support in a partially swung position, and FIG. 10 is a fragmentary perspective view partially cut away showing a modification of the tilt locking mechanism.

Figure 1:
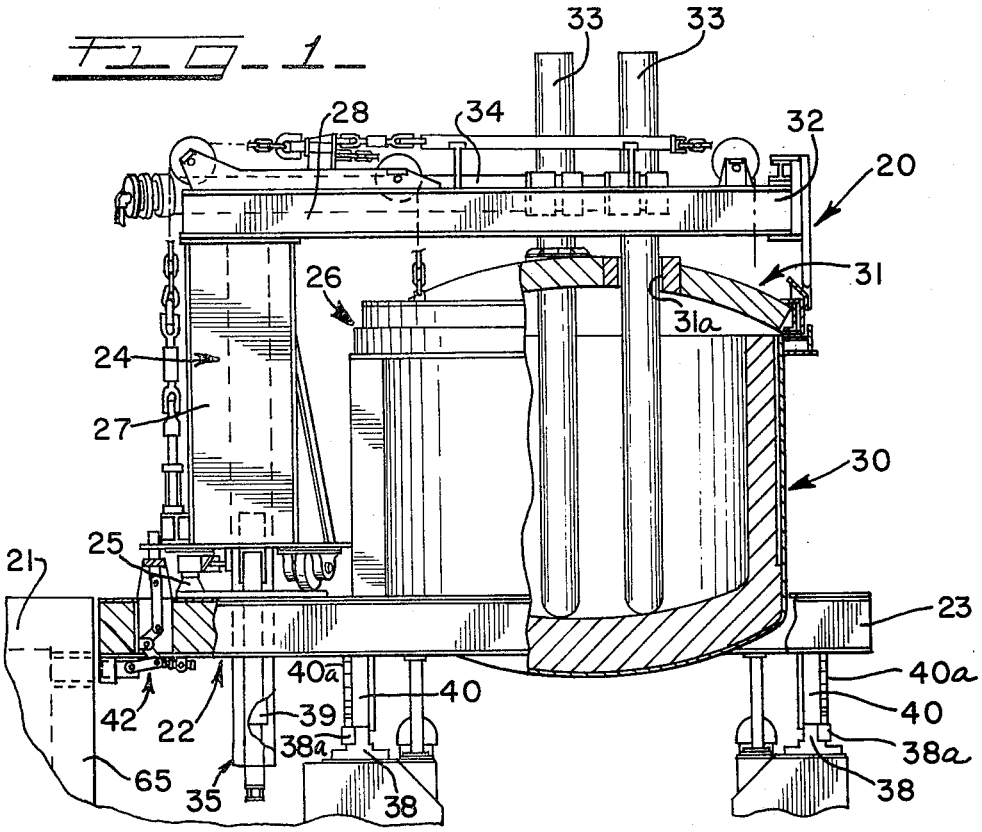
FIG. 1 is a front elevational view partially cut away of a top charge tiltable direct arc steel-making furnace including one embodiment of the interconnected tilt lock and swing lock mechanism of the invention.
Figure 3:
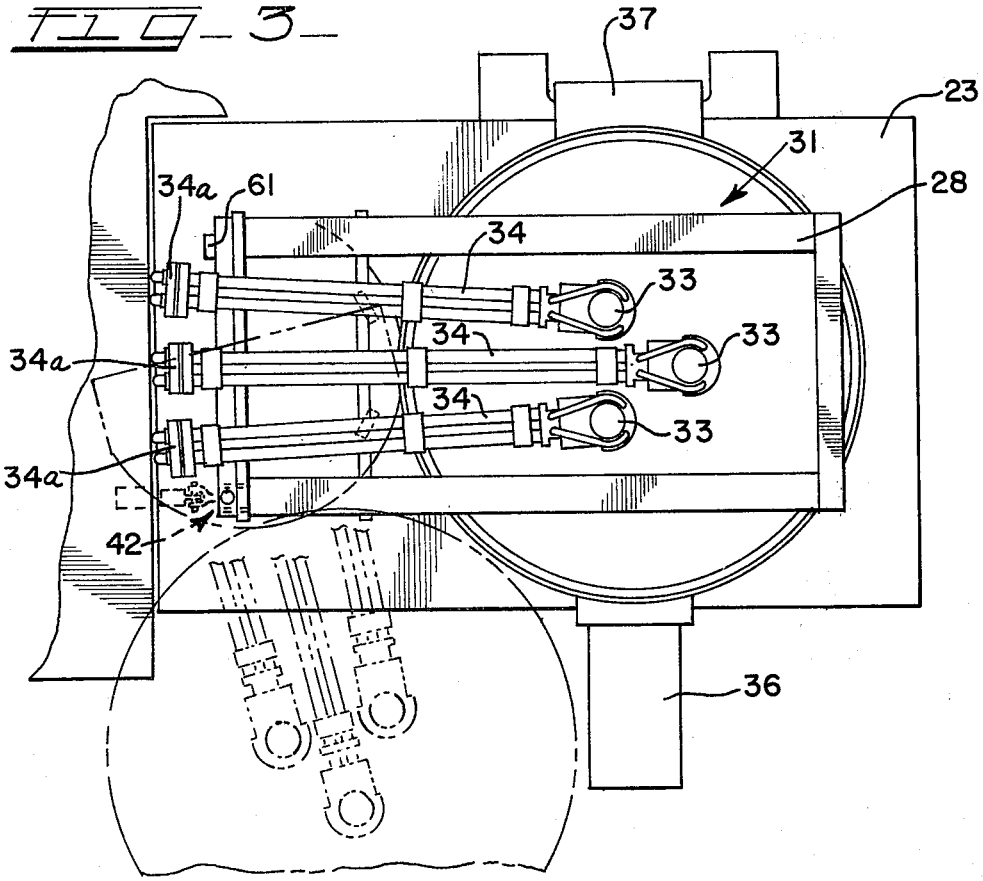
FIG. 3 is a top plan view of the furnace shown in FIG. 1 including in solid line the furnace roof including its supporting portion as mounted on top of the furnace, and the same in broken line as swung through an arc uncovering the top shell opening.
Figure 2:
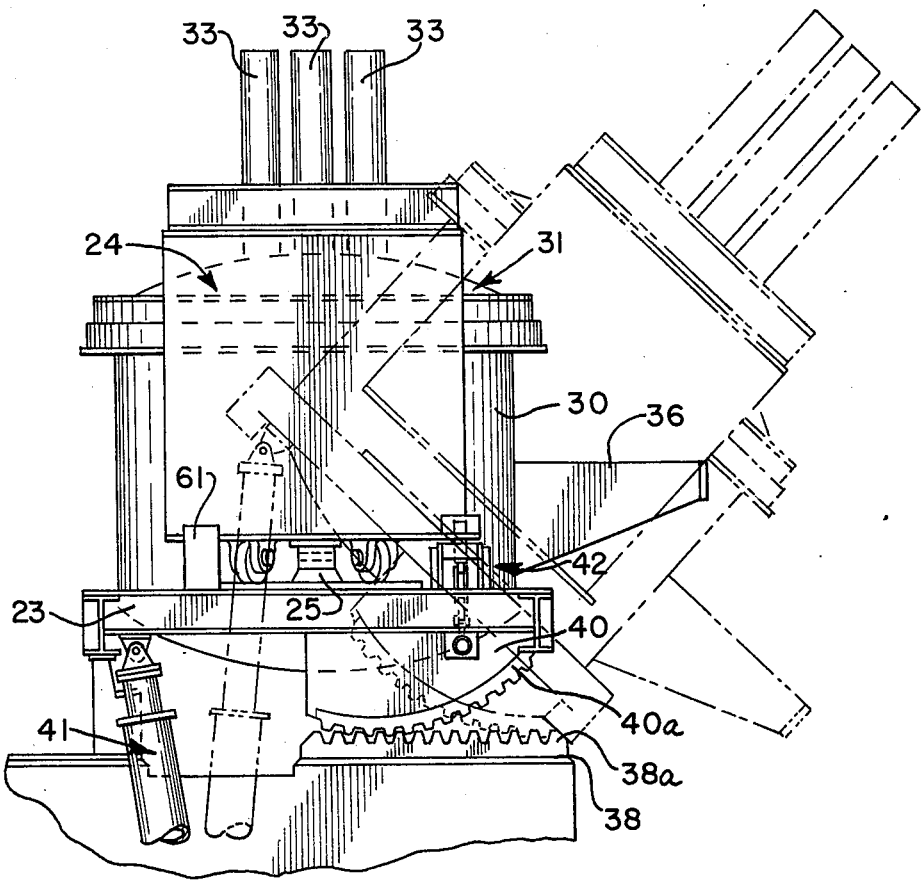
FIG. 2 is a side elevational view of the top charge tiltable direct arc electric steel-making furnace shown in solid line in its upright operating position and in broken line in its tilted position.

A top charge tiltable direct arc electric furnace is shown in FIGS. 1 through 3. Referring to FIG. 1, the direct arc electric furnace installation is indicated generally at 20. Furnace assembly 20 includes a foundation 21, preferably of poured and reinforced concrete; a tiltable framework, indicated generally at 22, which includes a generally rectangular base or frame platform 23. Furnace assembly 20 also includes a furnace body, generally at 26, including a bowl-shape refractory lined shell 30 which is mounted on rectangular platform 23, and a removable refractory lined top roof 31 suspended by a plurality of cables or chains 32-32 from a cantilevered roof supporting structure, generally indicated at 24, pivotally mounted in known manner at 25 to the platform 23. The cantilever supporting structure includes a vertical back plate assembly 27, and a substantially horizontal roof supporting member 28 extending in cantilevered form from the top thereof. Three electrodes 33-33 are vertically movably mounted to the supporting structure 24, positioned through the roof 31 at holes 31a, and protrude down into the shell 30 for arcing contact with a metal scrap charge. Each electrode 33 is held in position at the distal end of a cantilevered electrode mounting member or arm 34. Each mounting arm 34 is supported at its base 34a by a vertical extension or mast 35 guided for vertical movement in back plate assembly 27 by rollers (not shown) mounted therein. The individual vertical movement of each mast 35 is provided by a hydraulic cylinder 39 mounted therein. The hydraulic cylinder 39 drives the arm 34 and electrodes 33 up and down to regulate the arc and therefore the current in the furnace.

The roof 31 may be raised by operating the chains 32-32, and thereby allow the entire cantilever supporting structure 24 to be swung through an arc around its pivotal mounting 25 as shown in outline in FIG. 3. This arcuate movement uncovers the top opening in shell 30 and allows the furnace to be charged. Once the furnace is charged, the cantilever supporting structure 24 is returned to its mounted position as shown in solid line in FIG. 3, and roof 31 is lowered to close the shell 30.

After the charge is reduced to molten metal, the entire framework 22, the shell 30, and roof 31 are tiltable as shown in broken line in FIG. 2 for discharging the molten metal from the furnace body 26 through a pour spout 36 which extends to the forward side of the shell. The furnace framework 22, shell 30, and roof 31 are also slightly tiltable in the opposite direction. A slag door 37 (FIG. 3) on the opposite side of shell 30 from pour spout 36 is opened for facilitating the removal of slag from the furnace when it is tilted in the opposing direction.

The structure for supporting the framework 22 and the furnace body 26 mounted thereon includes a pair of parallel rails 38-38 (FIGS. 1, 2, and 9) mounted on the foundation 21, and parallel wheel segments 40-40 mounted to the lower side of the framework platform 23 so as to roll along the rails 38-38 during tilting. Rack gears 38a-38a mounted to the side of rail 38-38 mesh with corresponding ring gear segments **40*a*-40*a* mounted on the side of wheel segments 40-40** respectively to prevent slippage of the wheels as they roll along the rails.

The power supply for tilting the framework 22 includes two large hydraulic cylinders 41, pivotally mounted at one end to the bottom rear of frame platform 23 and at the other end (not shown) to the foundation 21. Cylinders 41 are extensible for raising the rear of the furnace which moves the gear wheel segments 40-40 along rack 38-38 and tilts forward and lowers the furnace front side and the pour spout 36 extending therefrom. The furnace framework 22 and furnace body 26 return to an upright position by the force of gravity.

As shown most clearly in FIG. 2, when the framework 22 and furnace body 26 are tilted, the entire structure moves forward as does its center of gravity. Normally, the center of gravity remains behind the point of furnace support during tilting, thus providing for returning the furnace to an upright position by the force of gravity. However, if the roof 31 is raised and pivoted to the position shown in outline from FIG. 3, the center of gravity is shifted in front of the point of furnace support. The weight of the roof 31 and its cantilever support structure 24 is substantial and if the furnace is not locked against tilting when the roof is raised, and swing such a shift forward of the center of gravity of the entire tiltable structure produces instability and tends to overturn the furnace. Therefore, a locking mechanism is needed for preventing the tilting of framework platform 23 and furnace body 26 unless the roof 31 and its cantilever support structure 24 are in an un-swung position over the top of bowl-shape shell 30.

Figure 4:
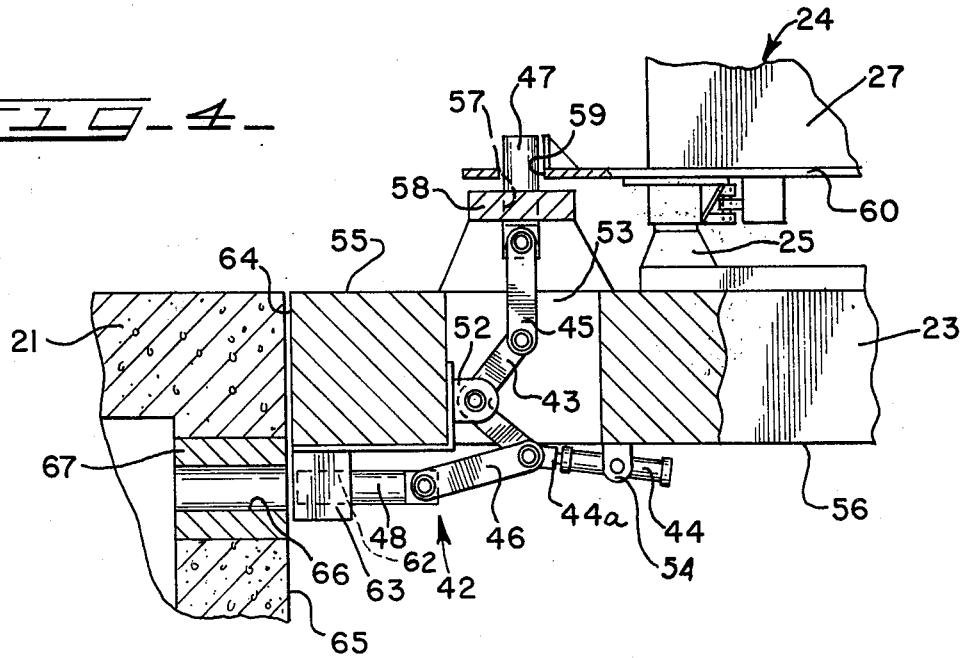
FIG. 4 is an enlarged fragmentary detail view partially cut away of a portion of FIG. 1 wherein the tilt lock mechanism is disengaged and the swing lock mechanism is engaged.

The tamper-resistant tilt and swing lock mechanism of applicant's invention is indicated generally at 42 in FIG. 1 and in enlarged detail in FIGS. 4 through 9. Referring to FIG. 4, the tilt and swing lock mechanism 42 includes: a pivotally mounted bellcrank or elbow member 43; a power drive 44 which, in this embodiment, is a hydraulic cylinder drivingly connected to the bellcrank to rotate same; and, pairs of dual-connecting links 45-45, 46-46, shown most clearly in FIG. 5, which are each attached at one of their ends to the bellcrank 43 and at the other of their ends to one of the respective swing and tilting lock pins 47, 48. The centrally positioned bellcrank 43 is pivotally attached to a first pivotal mounting bracket 52 mounted on the framework. The hydraulic cylinder 44 is also mounted to the platform 23 at a second pivotal mounting bracket 54 which is mounted to bottom surface 56 of platform 23.

The swing locking pin 47 attached to dual links 45-45 is restrained from horizontal movement by being slidably retained in an aperture 57 through a guide bracket 58. Bracket 58 is U-shaped and mounted to the top surface 55 of framework platform 23. A locking pin receiving aperture 59 extending vertically through horizontal member 60 of the back plate assembly 24 is positioned relative to the top of guide bracket 58 such that when the roof 31 is positioned directly over the body shell 30, guide aperture 57 and aperture 59 are in registration. Such registration allows the locking pin 47 to be guided upwardly through aperture 59 so as to lock the roof supporting structure in that position. Horizontal member 60 also prevents locking pin 47 for moving upwardly unless the apertures 57, 59 are in registration.

At the opposite end of the tilt and swing lock mechanism 42 the tilt locking pin 48, which is attached to bellcrank 43 through dual-connecting links 46-46, is guided in a horizontally oriented aperture 62 extending through a guide block 63. Guide block 63 is attached to the underside 56 of the framework platform 23 adjacent one end 64 thereof. A vertical wall 65 forming a boundary of foundation 21 is positioned adjacent the end 64 of platform 23. A block 67 is mounted in the foundation in conventional manner with its outer surface flush with wall 65. Block 67 includes a horizontally oriented tilt locking pin receiving aperture or pocket 66 which is positioned therein such that it is aligned with aperture 62 in guide block 63 when the framework platform 23 is in its level or untilted position thereby enabling the tilt locking pin 48 to engage aperture 66 to prevent tilting of the furnace. The rear of aperture 66 is open to allow any scrap material build-up to be pushed therethrough by the tilt locking pin 48 as it engages the aperture.

Figure 6:
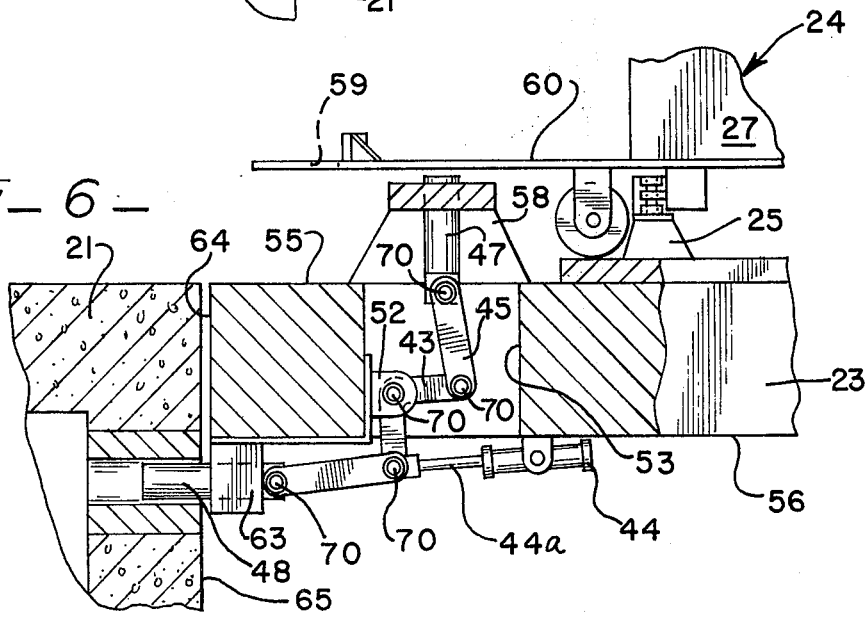
FIG. 6 is an enlarged fragmentary view partially cut away of the invention similar to FIG. 4 wherein the tilt lock mechanism is engaged and the swing lock mechanism is disengaged therefrom.

As shown most clearly in the sequence of movement from the tilt lock full engaged position shown in FIG. 6, through an intermediate both lock engaged position shown in FIG. 8, to the swing lock full engaged position shown in FIG. 4, mechanism 42 is arranged to prevent the possibility of both pins being disengaged at the same time. A substantial locking overlap is provided in the intermediate position of FIG. 8 such that the roof 31 is locked over the furnace shell 30 by pin 47 and the platform 23 is locked in horizontal position by pin 48 engaging opening 66. Therefore, both the platform 23 and cantilever support structure 24 are prevented from all movement while the locking mechanism is being switched from tilt lock full engaged position to swing lock full engaged position or vice versa.

Figure 5:
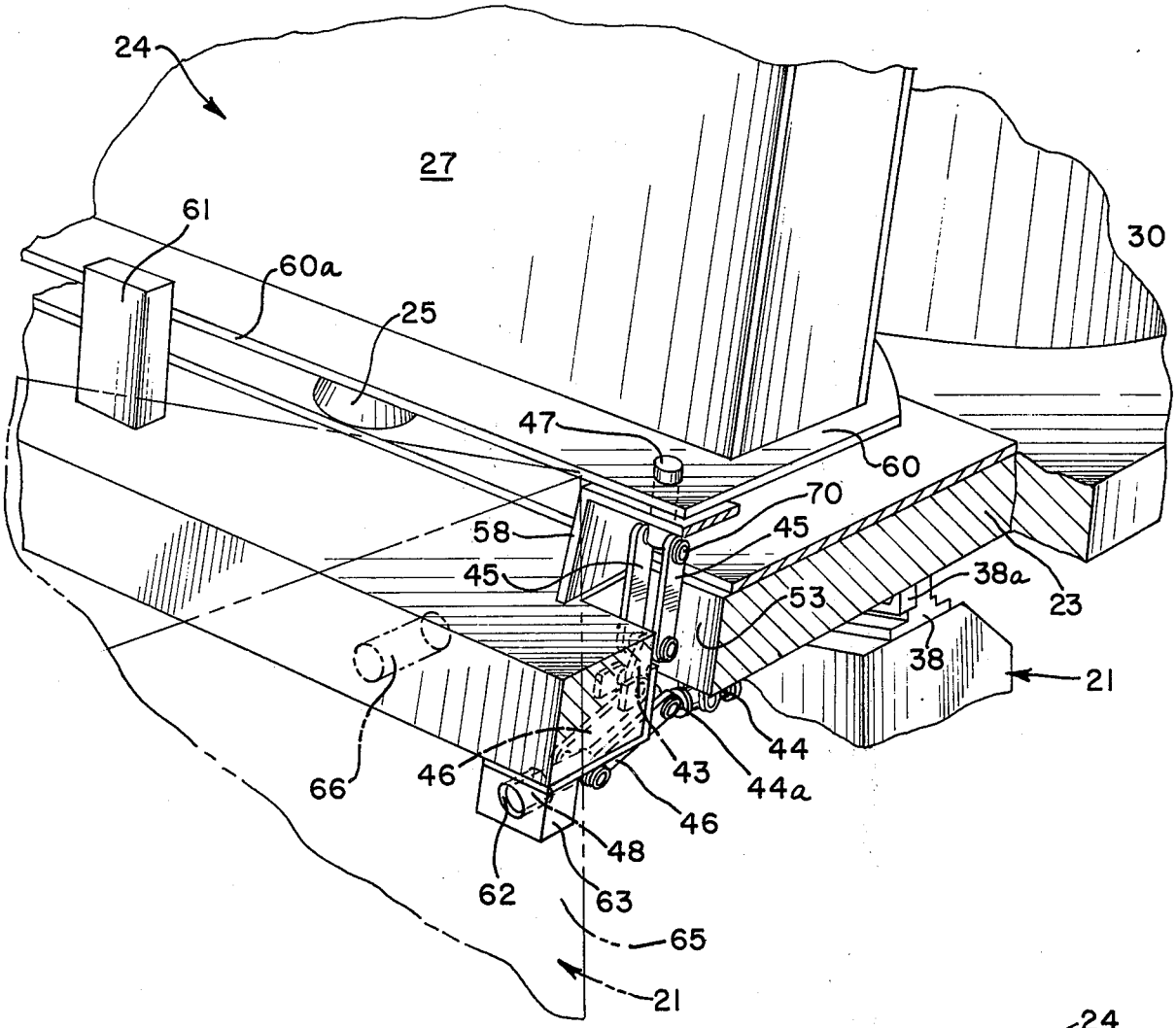
FIG. 5 is a fragmentary perspective view partially cut away of the tilt and swing locking mechanism as shown in FIG. 4, but with the furnace in tilted orientation.

In FIG. 5, the framework platform 23, shell 30, and back plate assembly 27 are shown in tilted position. Swing locking pin 47 is engaged in its pin receiving aperture 59 in horizontal member 60 thus preventing the roof supporting structure 24 from swinging arcuately, and tilt locking pin 48 is withdrawn and disengaged from its receiving aperture 66 by retracting the piston rod 44a into its hydraulic cylinder 44. The distance which the furnace moves forward during tilting is shown by the relative positions of the stationary tilting pin receiving aperture 66 in wall 65 and the tilt pin guide aperture 62 which is aligned with aperture 66 when the furnace is in upright position (FIG. 4). As most clearly shown in FIG. 5, when the furnace is in tilted position, foundation wall 65 blocks the outward movement of pin 48 and thereby prevents all further movement of the entire locking mechanism 42, including the disengagement of pin 47 in aperture 59, until platform 22 is horizontal and pin 48 is again engaged in aperture 66. This is true even though cylinder 44 should be unintentionally actuated.

In FIGS. 6 and 9 the tilt and swing lock mechanism 42 is shown with the swing locking pin 47 withdrawn and disengaged from its receiving aperture 59 in horizontal member 60 and with tilt locking pin 48 engaged in its receiving aperture 66 in wall 65. When the mechanism 42 is in this position, the roof 31 of the furnace body 26 may be raised and swung to one side through an arc by rotating the roof support structure 24 on its pivotal mounting 25 (FIG. 9) thereby allowing the shell 30 to be charged from the top. Swing locking pin 47 is disengaged from pin receiving aperture 62 by extending piston rod **44*a* from hydraulic cylinder 44 thus rotating the bellcrank 43 in a clock-wise direction and translating a downward component of movement through connecting link 45 to pin 47. As shown most clearly in FIG. 9, when the roof 31 and its cantilever supporting structure 24 are in a swung position, horizontal member 60 blocks the outward movement of pin 47 and thereby prevents all further movement of the entire locking mechanism 42, including the disengagement of pin 48 in aperture 66, until the roof 31 and its support structure 24 are positioned over shell 30. This is also true even though cylinder 44 should be unintentionally activated. It should be noted that the trailing edge 60*a* of horizontal member 60 never passes over pin 47 as a hydraulic cylinder (not shown) which swings the supporting structure wall not premit a reverse swing of sufficient angularity to uncover pin 47. Roof swing in a reverse opening direction may also be limited by a mechanical stop 61 secured to the platform in the path of a reverse opening swing of the supporting structure 24.**

While the geometry of the tilt and swing lock mechanism 42 prevents the simultaneous disengagement of both locking pins 47, 48 from their receiving apertures 59, 66 respectively, the preferred construction of the mechanism 42 and particularly all the link-connecting pins 70-70 provides a tamper-resistant means for preventing uncontrollable tilting of the furnace structure. Each link-connecting pin 70 in the mechanism is made of sturdy construction and includes case hardened bearing surfaces (not shown) on which both the connecting linkage arm mounting apertures and bellcrank mounting apertures, all case hardened, are rotatably pivotally mounted. The structure is the same at both ends connecting each link. An annular end cap 74 is welded at both ends connecting each link. An annular end cap 74 is welded on each pin 70 after the linkage has been assembled thereon for providing a permanently mounted pivot pin which is tamperresistant. With all pivotal bearing surfaces being case hardened, the need for lubrication is minimized.

Referring to FIG. 10 a second embodiment of the tilt and swing lock mechanism is indicated generally at 78. The second embodiment 78 is similar to first embodiment 42 except that in place of the single pin 48 it includes two tilt locking pins 79-79 positioned slidably in parallel oriented guide block apertures 80-80 in spaced apart guide blocks 81-81. Guide blocks 81-81 are mounted to the bottom 56 at each corner of the end 64 of framework platform 23 in similar manner to guide block 63 of the first embodiment. In the second embodiment, a rocking shaft 82 oriented parallel to end 64 of platform 24 is rotatably mounted in pillow blocks 83-83 fastened to the bottom 56 of the platform. Slotted arms 84-84 are rigidly mounted to each end of shaft 82. Transverse pin mountings 79*a*-79*a* on locking pins 79-79 respectively engage the slots 84*a*-84*a* on arms 84-84 such that actuation of hydraulic cylinder 44 moves both tilt lock pins 79-79 lockingly engage a pair of likewise spaced apart pin receiving apertures (not shown) positioned in the foundation wall in similar manner as aperture 66 of the first embodiment. When the twin tilt locking pins 79-79 engage their respective receiving apertures, they prevent the possibility of a single engaged tilt locking pin becoming the center of rotation around which the furnace platform may forceably be rotated in a aberational operating circumstance. The second embodiment 78 is desirable for preventing unintentional tilting of the framework platform 23 and the furnace body 26 mounted thereon by actuation of the tilt cylinders 41 after the tilt locking pins 79-79 are engaged in their receiving apertures.

While an electrical interlock (not shown) can be placed in the tilt and swing lock mechanism 42 to prevent the extension of hydraulic cylinder 41 after the tilt lock mechanism is engaged, most electrical circuits can be bypassed or avoided. If hydraulic cylinders 41 were extended while the tilt locking pin 48 of the first embodiment is engaged in its receiving aperture 66, locking pin 48 could then become a pivot around which the tiltable portion of the furnace tends to rotate. Even a relatively small rotation of the framework platform 23 and furnace body 26 may cause the ring gear segments 40*a*-40*a* to jump gears along the rack 38*a*-38*a* and cause the furnace to become skewed and unaligned between the two parallel rails 38-38 upon which the framework platform 23 is mounted. In FIG. 10 the twin spaced apart tilt lock pins 79-79 prevent the possibility of the tilt locking mechanism becoming a pivot for the tilting portion of the furnace.

It will be understood that certain changes may be made in the foregoing illustrative and preferred embodiments of the invention without departing from the spirit and scope thereof as defined in the appended claims. For example, the hydraulic cylinder 44 which is a power source for the tilt and swing lock mechanism 42 may be replaced with a rotatable screw in place of the piston rod 44a and a relatively stationary nut mounting in place of pivotal mounting 52. Secondly, the mounting aperture 66 may be formed directly in the concrete foundation 21, and thirdly, the dual-connecting links 45-45, 46-46 may each be replaced by an equivalent one piece connecting link. Therefore, the aim in the appended claims in to cover all such changes and modifications which fall within the true spirit and scope of the invention.

I claim:

1. In a top charge tiltable direct-arc electric furnace including a foundation, a framework tiltably mounted on said foundation, a furnace body mounted on said framework, and a roof which is swingable on said framework for opening and closing said body, the improvement comprising mechanically interconnected means for preventing said furnace body from tilting and for preventing said roof from being horizontally swung from over said body, and the engagement of said means for preventing said tilting being substantially overlapped with the engagement of said means for preventing said swinging whereby simultaneous displacement of said means allowing tilting and swinging is prevented.

2. The top charge tiltable direct-arc electric furnace as called for in claim 1 wherein the movement of both said means for preventing said tilting and said means for preventing said swinging into or out of an engaged position is prevented except when said framework and furnace body thereon are in a substantially level position.

3. The top charge tiltable direct arc electric furnace as called for in claim 1 wherein said mechanical means includes a first lock mechanism mounted to said framework for preventing the tilting of said framework on said foundation, a second lock mechanism mounted to said framework for preventing the horizontal swinging of said roof from over said body, a mechanical connection between said first and second locking mechanisms, said connection being pivotally mounted to said framework, said connection providing engagement of both said first and second lock mechanisms when in an intermediate position, the pivotal movement of said connection in one direction away from said intermediate position acting to disengage one of said first and second locking mechanisms, and the pivotal movement of said connection away from said intermediate position in the opposite direction from said one direction acting to disengage the other of said first and second locking mechanisms, and means for operating the pivotal movement of said mechanical connection.

4. In an electric arc furnace of the type having in combination:

a stationary foundation;

a supporting framework mounted upon said foundation;

a hollow shell means mounted in said framework which is enclosed at the bottom and open at the top;

removable roof means mounted on said supporting framework for covering the open top of said shell means;

said roof means being swingable through a horizontal arc and uncovering said shell for charging materials into said furnace;

said framework being tiltable upon said foundation for allowing molten metal to flow out of said shell means;

a first locking mechanism providing engagement between said framework and said foundation for preventing said furnace from tilting;

a second locking mechanism providing engagement between said roof means and said framework for preventing said cover from being horizontally swung from over said body;

a mechanical interconnection therebetween; and means preventing movement of said first and second locking mechanisms at all times except when said framework is substantially level.

5. The electric arc furnace called for in claim 4 wherein said first locking mechanism includes a first locking pin axially movably mounted in said framework for extending therefrom during locking engagement and for being recessed therein during disengagement, and a first recess in a surface of said foundation into which said pin may be rigidly engaged, said surface being positioned perpendicular to the axis of rotation of said tilting framework and adjacent said first locking pin, and said means for blocking the movement of said first locking mechanism once said furnace is tilted which includes said foundation surface.

6. The electric arc furnace called for in claim 5 wherein said first locking pin is aligned with said first recess when said framework is level.

7. The electric arc furnace called for in claim 4 wherein said second locking mechanism includes a second linking pin axially movably mounted in said framework for extending therefrom during locking engagement and for being recessed therein during disengagement, and a second recess in a surface on said roof means into which said pin may be rigidly engaged, said surface being positioned perpendicular to the axis of rotation of said roof means and adjacent said second locking pin, and said means for blocking the movement of said second locking mechanism once said roof is swung which includes said surface on said roof means.

8. The electric arc furnace called for in claim 6 wherein said second locking pin is aligned with said second recess when said roof means covers said furnace body.

9. The electric arc furnace called for in claim 4 wherein said first locking mechanism includes a first locking pin axially movably mounted in said framework for extending therefrom during locking engagement and for being recessed therein during disengagement, and a first stationary recess in a surface of said foundation into which said pin may be rigidly engaged, said surface being positioned perpendicular to the axis of rotation of said tilting framework and adjacent said first locking pin said second locking mechanism includes a second locking pin axially movably mounted in said framework for extending therefrom during locking engagement and for being recessed therein during disengagement, and a second recess in a surface on said roof means into which said pin may be rigidly engaged, said surface being positioned perpendicular to the axis of rotation of said roof means and adjacent said second locking pin, said means for blocking the movement of said first locking mechanism once said furnace is tilted includes said foundation surface, and said means for blocking the movement of said second locking mechanism once said roof is swung includes said surface on said roof means.

10. In an electric arc furnace of the type having a stationary foundation;

a supporting framework supported mounted upon said foundation;

a hollow shell means mounted on said framework which is enclosed at the bottom and open at the top;

a removable roof means mounted on said supporting framework for covering the open top of said shell means;

said roof means being swingable through a horizontal arc and uncovering said shell upon top for charging materials into said furnace;

said framework being tiltable upon said foundation for allowing molten metal to flow out of said shell means;

a first locking mechanism providing engagement between said framework and said foundation for preventing said furnace from tilting;

a second locking mechanism providing engagement between said roof means and said framework for preventing said roof from being horizontally swung from over said body;

a mechanical interconnection therebetween;

the engagement of said first lock mechanism being substantially overlapped through said mechanical interconnection with the engagement of said second locking mechanism whereby simultaneous disengagement of said first and second locking mechanisms is prevented;

said foundation blocking the movement of said first locking mechanism once said framework is tilted; and means on said furnace for blocking the movement of said second locking mechanism once said roof means is swung from over said body.

11. In an electric arc furnace of the type having in combination:

a stationary foundation;

a supporting framework mounted upon said foundation;

a hollow shell means mounted in said framework which is enclosed at the bottom and open at the top;

removable roof means mounted on said supporting framework for covering the open top of said shell means;

said roof means being swingable through a horizontal arc and uncovering said shell for charging materials into said furnace;

said framework being tiltable upon said foundation for allowing molten metal to flow out of said shell means;

a first locking mechanism providing engagement between said framework and said foundation for preventing said furnace from tilting;

a second locking mechanism providing engagement between said roof means and said framework for preventing said cover from being horizontally swung from over said body;

a mechanical interconnection therebetween;

said foundation blocking the movement of said first locking mechanism once said framework is tilted; and means on said furnace for blocking the movement of said second locking mechanism over said roof means is swung from over said body.

* * * * *

UNITED STATES PATENT AND TRADEMARK OFFICE

CERTIFICATE OF CORRECTION

PATENT NO. : 3,980,801

DATED : September 14, 1976

INVENTOR(S) : Algimantas Milasius

It is certified that error appears in the above-identified patent and that said Letters Patent are hereby corrected as shown below:

Column 8, Line 14, delete "displacement" and insert --disengagement--;

Column 9, Line 28, delete "linking" and insert --locking--;

Column 10, Line 6, delete "supported";

Column 10, Line 15, delete "upon" and insert --open--;

Column 10, Line 66, delete "over" and insert --once--.

Signed and Sealed this

Fourth Day of January 1977

[SEAL]

*Attest:*

RUTH C. MASON
*Attesting Officer*

C. MARSHALL DANN
*Commissioner of Patents and Trademarks*